US011393334B2

(12) United States Patent
Sheynman et al.

(10) Patent No.: US 11,393,334 B2
(45) Date of Patent: *Jul. 19, 2022

(54) METHOD, APPARATUS, AND COMPUTER PROGRAM PRODUCT FOR DETECTING CHANGES IN ROAD TRAFFIC CONDITION

(71) Applicant: HERE GLOBAL B.V., Eindhoven (NL)

(72) Inventors: Arnold Sheynman, Northbrook, IL (US); Daniela Radakovic, Chicago, IL (US); Kyle Jackson, Chicago, IL (US)

(73) Assignee: HERE GLOBAL B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 17/154,524

(22) Filed: Jan. 21, 2021

(65) Prior Publication Data

US 2021/0142661 A1 May 13, 2021

Related U.S. Application Data

(63) Continuation of application No. 16/849,688, filed on Apr. 15, 2020, now Pat. No. 10,943,474, which is a (Continued)

(51) Int. Cl.
*G08G 1/01* (2006.01)

(52) U.S. Cl.
CPC ..... *G08G 1/0141* (2013.01); *G08G 1/0112* (2013.01)

(58) Field of Classification Search
CPC ... G08G 1/0141; G08G 1/0104; G08G 1/0112
See application file for complete search history.

(56) References Cited

U.S. PATENT DOCUMENTS 9,240,123 B2 1/2016 Stenneth
9,881,497 B2 1/2018 Chen et al.
(Continued)

FOREIGN PATENT DOCUMENTS

CN 104680785 A 6/2015
CN 105261217 A 1/2016

OTHER PUBLICATIONS

U.S. Appl. No. 16/849,688, filed Apr. 15, 2020, 2020-0349834, Allowed.

(Continued)

*Primary Examiner* — Curtis B Odom
(74) *Attorney, Agent, or Firm* — Alston & Bird LLP

(57) ABSTRACT

A method, apparatus, and computer program product are provided for detecting changes in road traffic conditions based on vehicle probe data. Methods may include: receiving a plurality of probe data points; map-matching probe data points of the plurality of probe apparatuses to road segments of a candidate road of a road networks; for a plurality of time epochs, cluster probe speeds map-matched to road segments of the candidate road according to a clustering algorithm; establishing centroid speeds corresponding to clusters of probe speeds; spatially grouping said road segments according to probe-to-cluster mapping; and providing a road traffic condition change message in response to a difference between centroid speeds along the candidate road exceeding a predefined threshold, where the road traffic condition change message includes at least information about said road segment groups that correspond to said clusters.

20 Claims, 11 Drawing Sheets

Related U.S. Application Data continuation of application No. 16/402,333, filed on May 3, 2019, now Pat. No. 10,657,807.

(56) References Cited

U.S. PATENT DOCUMENTS

| | | | | |
|---|---|---|---|---|
| 10,657,807 | B1 * | 5/2020 | Sheynman | G08G 1/0141 |
| 10,943,474 | B2 * | 3/2021 | Sheynman | G08G 1/0141 |
| 2007/0208501 | A1 | 9/2007 | Downs et al. | |

OTHER PUBLICATIONS

U.S. Appl. No. 16/402,333, filed May 3, 2019, U.S. Pat. No. 10,657,807, Issued.

Jenks Natural Breaks Optimization [online] [retrieved Jun. 13, 2019], Retrieved from the Internet: <URL: https://ipfs.io/ipfs/QmXoypizjW3WknFiJnKLwHCnL72vedxjQkDDPlmXWo6uco/wiki/Jenks_natural_breaks_optimization.html>. (May 2017) 2 pages.

Hellinga, B. et al., Decomposing Travel Times Measured by Probe-Based Traffic Monitoring Systems to Individual Road Segments, Transportation Research Part C 16 (2008) 768-782, 43 pages.

Notice of Allowance for U.S. Appl. No. 16/402,333 dated Jan. 13, 2020.

Notice of Allowance for U.S. Appl. No. 16/849,688 dated Oct. 22, 2020.

* cited by examiner $$GVF = 1 - \frac{minimal_variation}{dataset_variation}$$

360

Per component multiplication $\{V_1,V_2,V_3,V_4,V_5\}$

Binary table (1)

| | | | | | |
|---|---|---|---|---|---|
| 1 | 0 | 0 | 0 | 0 | -> var 1,1 |
| 0 | 1 | 0 | 0 | 0 | -> var 1,2 |
| 1 | 1 | 0 | 0 | 0 | |
| 0 | 0 | 1 | 0 | 0 | |
| 1 | 0 | 1 | 0 | 0 | |
| 0 | 1 | 1 | 0 | 0 | |
| 1 | 1 | 1 | 0 | 0 | |
| 0 | 0 | 0 | 1 | 0 | |
| 1 | 0 | 0 | 1 | 0 | |
| 0 | 1 | 0 | 1 | 0 | |
| 1 | 1 | 0 | 1 | 0 | |
| 0 | 0 | 1 | 1 | 0 | |
| 1 | 0 | 1 | 1 | 0 | |
| 0 | 1 | 1 | 1 | 0 | |
| 1 | 1 | 1 | 1 | 0 | |
| 0 | 0 | 0 | 0 | 1 | -> var 1,16 |

Per component multiplication $\{V_1,V_2,V_3,V_4,V_5\}$

Complementary binary table (2)

| | | | | | |
|---|---|---|---|---|---|
| 0 | 1 | 1 | 1 | 1 | -> var 2,1 |
| 1 | 0 | 1 | 1 | 1 | -> var 2,2 |
| 0 | 0 | 1 | 1 | 1 | |
| 1 | 1 | 0 | 1 | 1 | |
| 0 | 1 | 0 | 1 | 1 | |
| 1 | 0 | 0 | 1 | 1 | |
| 0 | 0 | 0 | 1 | 1 | |
| 1 | 1 | 1 | 0 | 1 | |
| 0 | 1 | 1 | 0 | 1 | |
| 1 | 0 | 1 | 0 | 1 | |
| 0 | 0 | 1 | 0 | 1 | |
| 1 | 1 | 0 | 0 | 1 | |
| 0 | 1 | 0 | 0 | 1 | |
| 1 | 0 | 0 | 0 | 1 | |
| 0 | 0 | 0 | 0 | 1 | |
| 1 | 1 | 1 | 1 | 0 | -> var 2,16 |

$$\min_{i=1,2,\ldots,N} \{ (var1,i+var2,i) \}$$

FIG. 7

| | |
|---|---|
| 11:18:XX | 67 |
| 11:18:XX | 66 |
| 11:18:XX | 58 |
| 11:18:XX | 63 |
| 11:18:XX | 57 |

415

| | |
|---|---|
| 11:19:XX | 62 |
| 11:19:XX | 20 |
| 11:19:XX | 59 |
| 11:19:XX | 10 |
| 11:19:XX | 11 |

420

| | |
|---|---|
| 11:20:XX | 19 |
| 11:20:XX | 15 |

425

| | |
|---|---|
| 11:21:XX | NULL |

430

| | |
|---|---|
| 11:22:XX | 21 |
| 11:22:XX | 27 |
| 11:22:XX | 20 |
| 11:22:XX | 57 |
| 11:22:XX | 52 |
| 11:22:XX | 18 |
| 11:22:XX | 12 |
| ... | ... |
| 11:22:XX | 22 |
| 11:22:XX | 48 |
| 11:22:XX | 60 |
| 11:22:XX | 16 |
| 11:22:XX | 19 |
| 11:22:XX | 25 |

| | |
|---|---|
| 11:18:XX | 67 |
| 11:18:XX | 66 |
| 11:18:XX | 58 |
| 11:18:XX | 63 |
| 11:18:XX | 57 |

VAR=20.7*(Np-1)=20.7*4=82.8

Np – Number of probes

450

$$Goodness_{Var} = 1 - \frac{\min(VAR1+VAR2)}{VAR} = 1 - \frac{9.17}{82.8} = 0.89$$

440

445

| | Binary table (1) | | | | | VAR1 | Complementary binary table (2) | | | | | VAR2 | VAR1+VAR2 |
|---|---|---|---|---|---|---|---|---|---|---|---|---|---|
| 0 | 67 | 0 | 0 | 0 | 0 | 0 | 0 | 66 | 58 | 63 | 57 | 54 | 54 |
| 1 | 0 | 66 | 0 | 0 | 0 | 0 | 67 | 0 | 58 | 63 | 57 | 64.75 | 64.75 |
| 2 | 67 | 66 | 0 | 0 | 0 | 0.5 | 0 | 0 | 58 | 63 | 57 | 20.67 | 21.17 |
| 3 | 0 | 0 | 58 | 0 | 0 | 0 | 67 | 66 | 0 | 63 | 57 | 60.75 | 60.75 |
| 4 | 67 | 0 | 58 | 0 | 0 | 40.5 | 0 | 66 | 0 | 63 | 57 | 42 | 82.5 |
| 5 | 0 | 66 | 58 | 0 | 0 | 32 | 67 | 0 | 0 | 63 | 57 | 50.67 | 82.67 |
| 6 | 67 | 66 | 58 | 0 | 0 | 48.67 | 0 | 0 | 0 | 63 | 57 | 18 | 66.67 |
| 7 | 0 | 0 | 0 | 63 | 0 | 0 | 67 | 66 | 58 | 0 | 57 | 82 | 82 |
| 8 | 67 | 0 | 0 | 63 | 0 | 8 | 0 | 66 | 58 | 0 | 57 | 48.67 | 56.67 |
| 9 | 0 | 66 | 0 | 63 | 0 | 4.5 | 67 | 0 | 58 | 0 | 57 | 60.67 | 65.17 |
| 10 | 67 | 66 | 0 | 63 | 0 | 8.67 | 0 | 0 | 58 | 0 | 57 | 0.5 | 9.17 |
| 11 | 0 | 0 | 58 | 63 | 0 | 12.5 | 67 | 66 | 0 | 0 | 57 | 60.67 | 73.17 |
| 12 | 67 | 0 | 58 | 63 | 0 | 40.67 | 0 | 66 | 0 | 0 | 57 | 40.5 | 81.17 |
| 13 | 0 | 66 | 58 | 63 | 0 | 32.67 | 67 | 0 | 0 | 0 | 57 | 50 | 82.67 |
| 14 | 67 | 66 | 58 | 63 | 0 | 49 | 0 | 0 | 0 | 0 | 57 | 0 | 49 |
| 15 | 0 | 0 | 0 | 0 | 57 | 0 | 67 | 66 | 58 | 63 | 0 | 49 | 49 |

mean = 65.33 mean = 57.5

Min(VAR1+VAR2)

| | |
|---|---|
| 11:19:XX | 62 |
| 11:19:XX | 20 |
| 11:19:XX | 59 |
| 11:19:XX | 10 |
| 11:19:XX | 11 |

VAR=674.3*(Np-1)=674.3*4=2697.2

Np – Number of probes

460

$$Goodness_{Var} = 1 - \frac{\min(VAR1+VAR2)}{VAR} = 1 - \frac{65.17}{2697.2} = 0.98$$

| | Binary table (1) | | | | | VAR1 |
|---|---|---|---|---|---|---|
| 0 | 62 | 0 | 0 | 0 | 0 | 0.0 |
| 1 | 0 | 20 | 0 | 0 | 0 | 0.0 |
| 2 | 62 | 20 | 0 | 0 | 0 | 882.0 |
| 3 | 0 | 0 | 59 | 0 | 0 | 0.0 |
| 4 | 62 | 0 | 59 | 0 | 0 | 4.5 |
| 5 | 0 | 20 | 59 | 0 | 0 | 760.5 |
| 6 | 62 | 20 | 59 | 0 | 0 | 1098.0 |
| 7 | 0 | 0 | 0 | 10 | 0 | 0.0 |
| 8 | 62 | 0 | 0 | 10 | 0 | 1352.0 |
| 9 | 0 | 20 | 0 | 10 | 0 | 50 |
| 10 | 62 | 20 | 0 | 10 | 0 | 1522.7 |
| 11 | 0 | 0 | 59 | 10 | 0 | 1200.5 |
| 12 | 62 | 0 | 59 | 10 | 0 | 1704.7 |
| 13 | 0 | 20 | 59 | 10 | 0 | 1340.7 |
| 14 | 62 | 20 | 59 | 10 | 0 | 2124.8 |
| 15 | 0 | 0 | 0 | 0 | 11 | 0.0 |

mean = 60.5

| Complementary binary table (2) | | | | | VAR2 | VAR1+VAR2 |
|---|---|---|---|---|---|---|
| 0 | 20 | 59 | 10 | 11 | 1602.0 | 1602.00 |
| 62 | 0 | 59 | 10 | 11 | 2505.0 | 2505.00 |
| 0 | 0 | 59 | 10 | 11 | 1558.7 | 2450.67 |
| 62 | 20 | 0 | 10 | 11 | 1812.8 | 1812.75 |
| 0 | 20 | 0 | 10 | 11 | 60.7 | 65.17 |
| 62 | 0 | 0 | 10 | 11 | 1768.7 | 2529.17 |
| 0 | 0 | 0 | 10 | 11 | 0.5 | 1098.50 |
| 62 | 20 | 59 | 0 | 11 | 2070.0 | 2070.00 |
| 0 | 20 | 59 | 0 | 11 | 1302.0 | 2654.00 |
| 62 | 0 | 59 | 0 | 11 | 1638.0 | 1688.00 |
| 0 | 0 | 59 | 0 | 11 | 1152.0 | 2674.67 |
| 62 | 20 | 0 | 0 | 11 | 1482.0 | 2682.50 |
| 0 | 20 | 0 | 0 | 11 | 40.5 | 1745.17 |
| 62 | 0 | 0 | 0 | 11 | 1300.5 | 2641.17 |
| 0 | 0 | 0 | 0 | 11 | 0.0 | 2124.75 |
| 62 | 20 | 59 | 63 | 0 | 2124.8 | 2124.75 |

mean = 13.7

Min(VAR1+VAR2)

METHOD, APPARATUS, AND COMPUTER PROGRAM PRODUCT FOR DETECTING CHANGES IN ROAD TRAFFIC CONDITION

CROSS-REFERENCE TO RELATED APPLICATIONS

This application is a continuation of and claims priority to U.S. patent application Ser. No. 16/849,688, filed on Apr. 15, 2020, which is a continuation of and claims priority to U.S. patent application Ser. No. 16/402,333, filed on May 3, 2019, the contents of each of which are hereby incorporated by reference in their entirety.

TECHNOLOGICAL FIELD

An example embodiment of the present invention relates to detecting changes in road traffic conditions, and more particularly, to detecting changes in road traffic conditions based on an analysis of road segments over time epochs to reduce latency in establishing changes in the road traffic conditions.

BACKGROUND

Maps have been used for centuries for providing route geometry and geographical information. Conventional paper maps including static images of roadways and geographic features from a snapshot in history have given way to digital maps presented on computers and mobile devices. These digital maps can be updated and revised such that users have the most-current maps available to them each time they view a map hosted by a mapping service server. Digital maps can further be enhanced with dynamic information, such as vehicle speed profile information based on historical speed profiles of vehicles traveling along a road network.

Vehicle and traffic data that is provided on digital maps is generally based on crowd-sourced data from mobile devices or probe data. The traffic data is typically reflective of a collective group of mobile devices traveling along a road segment, and may be useful in vehicle navigation applications in order for a user to avoid heavy or slow traffic routes between an origin and a destination. However, dynamic computation of traffic speeds along routes can often suffer from shortcomings such as identifying traffic speeds inaccurately with low latency, or with high accuracy and high latency.

BRIEF SUMMARY

A method, apparatus, and computer program product are provided in accordance with an example embodiment for detecting changes in road traffic conditions based on vehicle probe data. Embodiments provided herein may include a method for detecting changes in road traffic conditions. Methods may include: receiving a plurality of probe data points, each probe data point received from a probe apparatus of a plurality of probe apparatuses, each probe apparatus including one or more sensors and being onboard a respective vehicle, where each probe data point includes location information associated with the respective probe apparatus and having at least speed and timestamp information associated with the respective probe apparatus; map-matching probe data points of the plurality of probe apparatuses to road segments of a candidate road of a road networks; for a plurality of time epochs, cluster probe speeds map-matched to road segments of the candidate road according to a clustering algorithm; establishing centroid speeds corresponding to clusters of probe speeds; spatially grouping said road segments according to probe-to-cluster mapping; and providing a road traffic condition change message in response to a difference between centroid speeds along the candidate road exceeding a predefined threshold, where the road traffic condition change message includes at least information about said road segment groups that correspond to said clusters.

According to some embodiments, clustering probe speeds according to road segments and a clustering algorithm for each time epoch includes: calculating cluster variances using a set of pre-calculated binary tables; minimizing a sum of at least two cluster variances in the set of pre-calculated binary tables; and identifying clusters based on the minimized sum of at least two cluster variances. The set of pre-calculated binary tables may include a main binary table and a complementary binary table. A predefined number of probe data points may be identified for each cluster, where a dimension of said binary tables may be established as 2^(N−1) where N is the predefined number of probe data points. Methods may include grouping consecutive road segments according to centroid speed correspondence. The road traffic condition change message may include centroid speeds of each group of consecutive road segments. Methods may include failing to establish a centroid speed corresponding to a cluster of probe speeds for a respective road segment and time epoch in response to a number of probe data points corresponding to the road segment and time epoch failing to satisfy a predetermined number.

Embodiments provided herein may include an apparatus for detecting changes in road traffic conditions. The apparatus may include: means for receiving a plurality of probe data points, each probe data point received from a probe apparatus of a plurality of probe apparatuses, each probe apparatus including one or more sensors and being onboard a respective vehicle, where each probe data point includes location information associated with the respective probe apparatus and having at least speed and timestamp information associated with the respective probe apparatus; means for map-matching probe data points of the plurality of probe apparatuses to road segments of a candidate road of a road networks; for a plurality of time epochs, means for cluster probe speeds map-matched to road segments of the candidate road according to a clustering algorithm; means for establishing centroid speeds corresponding to clusters of probe speeds; means for spatially grouping said road segments according to probe-to-cluster mapping; and means for providing a road traffic condition change message in response to a difference between centroid speeds along the candidate road exceeding a predefined threshold, where the road traffic condition change message includes at least information about said road segment groups that correspond to said clusters.

According to some embodiments, the means for clustering probe speeds according to road segments and a clustering algorithm for each time epoch includes: means for calculating cluster variances using a set of pre-calculated binary tables; means for minimizing a sum of at least two cluster variances in the set of pre-calculated binary tables; and means for identifying clusters based on the minimized sum of at least two cluster variances. The set of pre-calculated binary tables may include a main binary table and a complementary binary table. A predefined number of probe data points may be identified for each cluster, where a dimension of said binary tables may be established as 2^(N−1) where N is the predefined number of probe data points. The apparatus may include means for grouping consecutive road segments according to centroid speed correspondence. The road traffic condition change message may include centroid speeds of each group of consecutive road segments. The apparatus may include means for failing to establish a centroid speed corresponding to a cluster of probe speeds for a respective road segment and time epoch in response to a number of probe data points corresponding to the road segment and time epoch failing to satisfy a predetermined number.

Embodiments provided herein may include an apparatus having processing circuitry and at least one memory including computer program code. The at least one memory and computer program code may be configured to, with the processor, cause the apparatus to at least: receive a plurality of probe data points, each probe data point received from a probe apparatus of a plurality of probe apparatuses, each probe apparatus including one or more sensors and being onboard a respective vehicle, where each probe data point includes location information associated with the respective probe apparatus and having at least speed and timestamp information associated with the respective probe apparatus; map match probe data points of the plurality of probe apparatuses to road segments of a candidate road of a road network; for a plurality of time epochs, cluster probe speeds map-matched to road segments of the candidate road according to a clustering algorithm; establish centroid speeds corresponding to clusters of probe speeds; spatially group said road segments according to probe-to-cluster mapping; and provide a road traffic condition change message in response to a difference between centroid speeds along the candidate road exceeding a predefined threshold, where the road traffic condition change message includes at least information about said road segment groups that correspond to said clusters.

According to some embodiments, causing the apparatus to cluster probe speeds according to road segments and a clustering algorithm for each time epoch includes causing the apparatus to: calculate cluster variances using a set of pre-calculated binary tables; minimize a sum of at least two cluster variances in the set of pre-calculated binary tables; and identify clusters based on the minimized sum of at least two cluster variances. The set of pre-calculated binary tables may include a main binary table and a complementary binary table. A predefined number of probe data points may be identified for each cluster, where a dimension of the binary tables may be established as $2^{(N-1)}$, where N is the predefined number of probe data points. The apparatus may be caused to group consecutive road segments according to centroid speed correspondence. The road traffic condition change message may include centroid speeds of each group of consecutive road segments. The apparatus may be caused to fail to establish a centroid speed corresponding to a cluster of probe speeds for a respective road segment and time epoch in response to a number of probe data points corresponding to the road segment and time epoch failing to satisfy a predetermined number.

Embodiments provided herein may include a computer program product having at least one non-transitory computer-readable storage medium having computer-executable program code portions stored therein. The computer-executable program code portions may include program code instructions configured to: receive a plurality of probe data points, each probe data point received from a probe apparatus of a plurality of probe apparatuses, each probe apparatus including one or more sensors and being onboard a respective vehicle, where each probe data point include location information associated with the respective probe apparatus and having at least speed and timestamp information associated with the respective probe apparatus; map-match probe data points of the plurality of probe apparatuses to road segments of a candidate road of a road network; for a plurality of time epochs, cluster probe speeds map-matched to road segments of the candidate road according to a clustering algorithm; establish centroid speeds corresponding to clusters of probe speeds; spatially group the road segments according to probe-to-cluster mapping; and provide a road traffic condition change message in response to a difference between centroid speeds along the candidate road exceeding a predefined threshold, where the road traffic condition change message may include at least information about said road segment groups that correspond to the clusters.

According to some embodiments, the program code instructions to cluster probe speeds according to road segments and a clustering algorithm for each time epoch may include program code instructions to: calculate cluster variances using a set of pre-calculated binary tables; minimize a sum of at least two cluster variances in the set of pre-calculated binary tables; and identify clusters based on the minimized sum of at least two cluster variances. The set of pre-calculated binary tables may include a main binary table and a complementary binary table. A predefined number of probe data points may be identified for each cluster, where a dimension of the binary tables may be established as $2^{(N-1)}$, where N is the predefined number of probe data points. Embodiments may include program code instructions to group consecutive road segments according to centroid speed correspondence. The road traffic condition change message may include centroid speeds of each group of consecutive road segments.

BRIEF DESCRIPTION OF THE DRAWINGS

Figure 1:
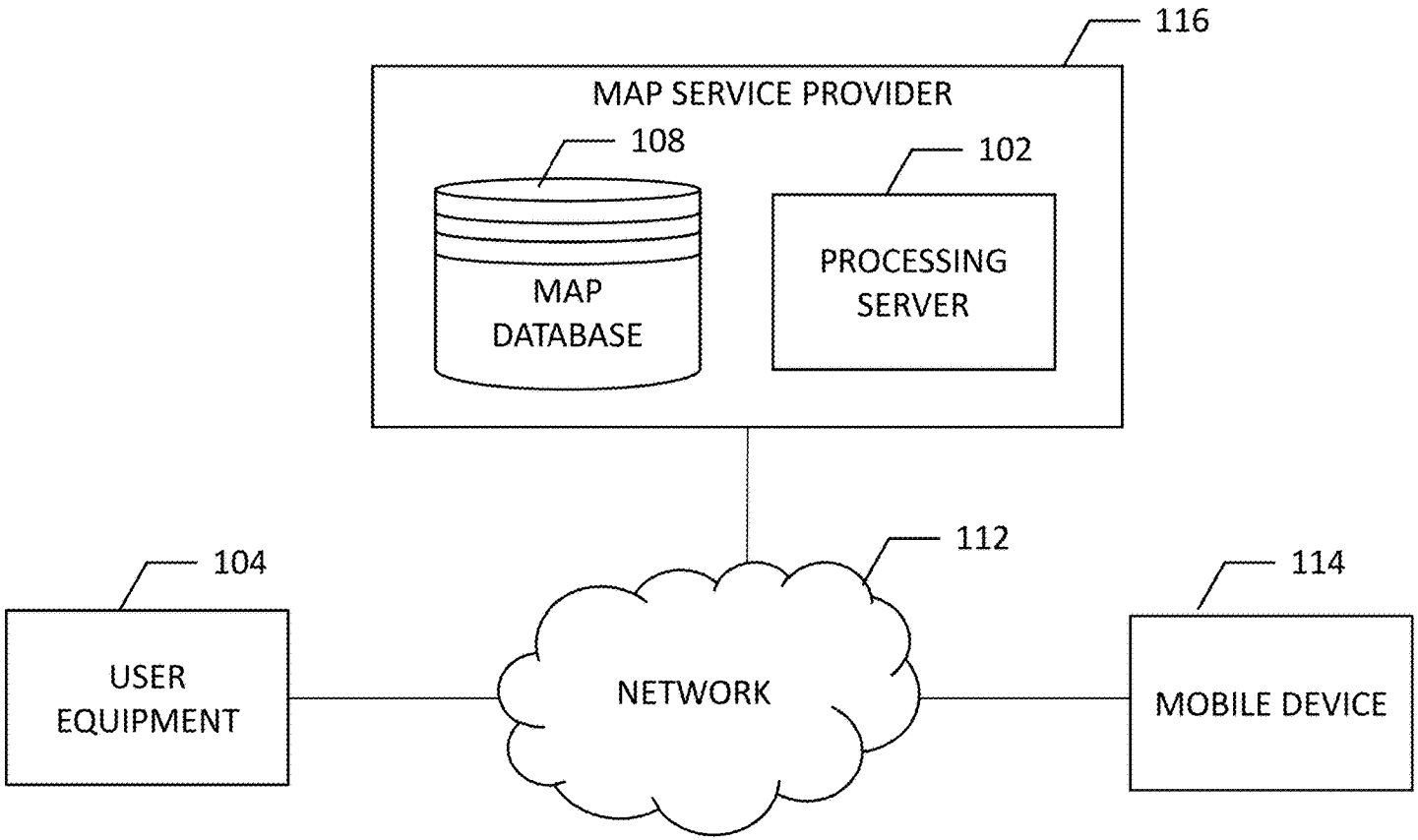
Figure 2:
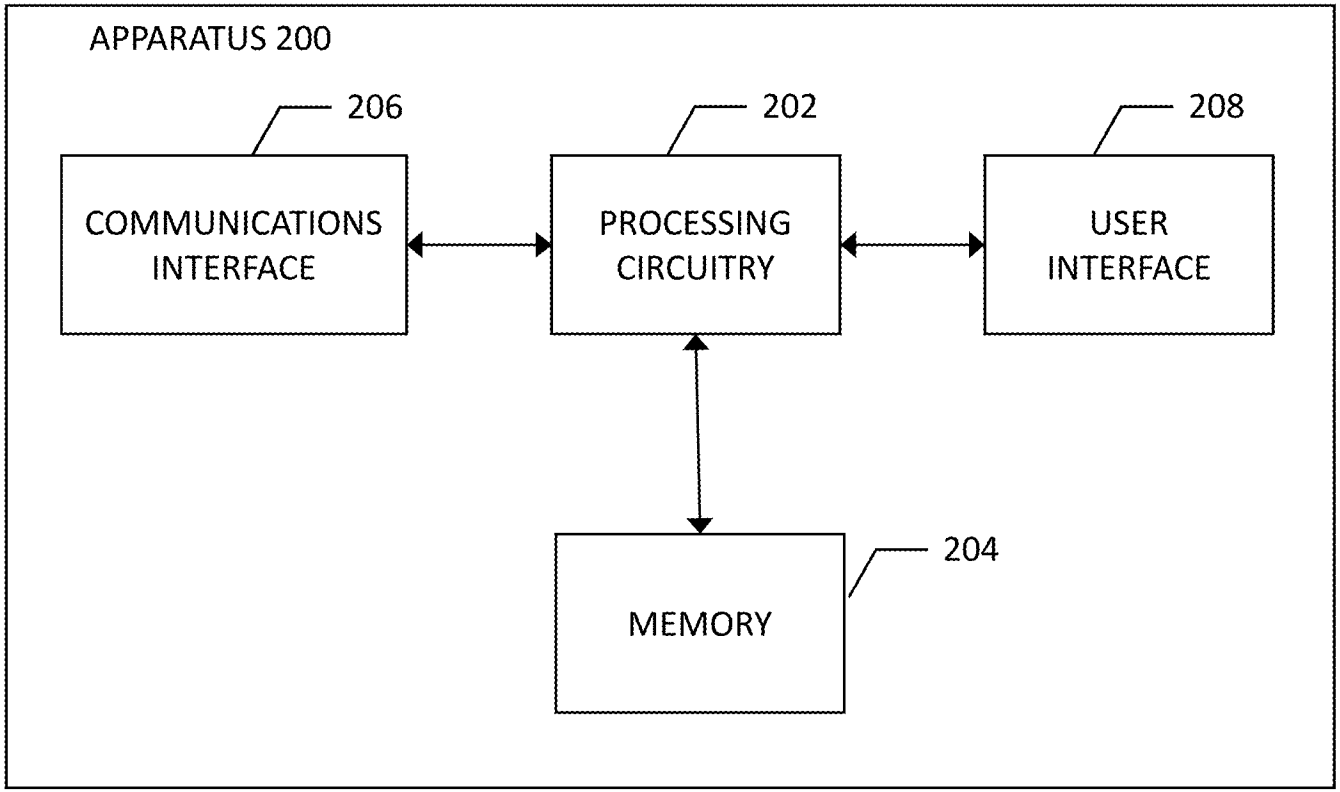
Figure 3:
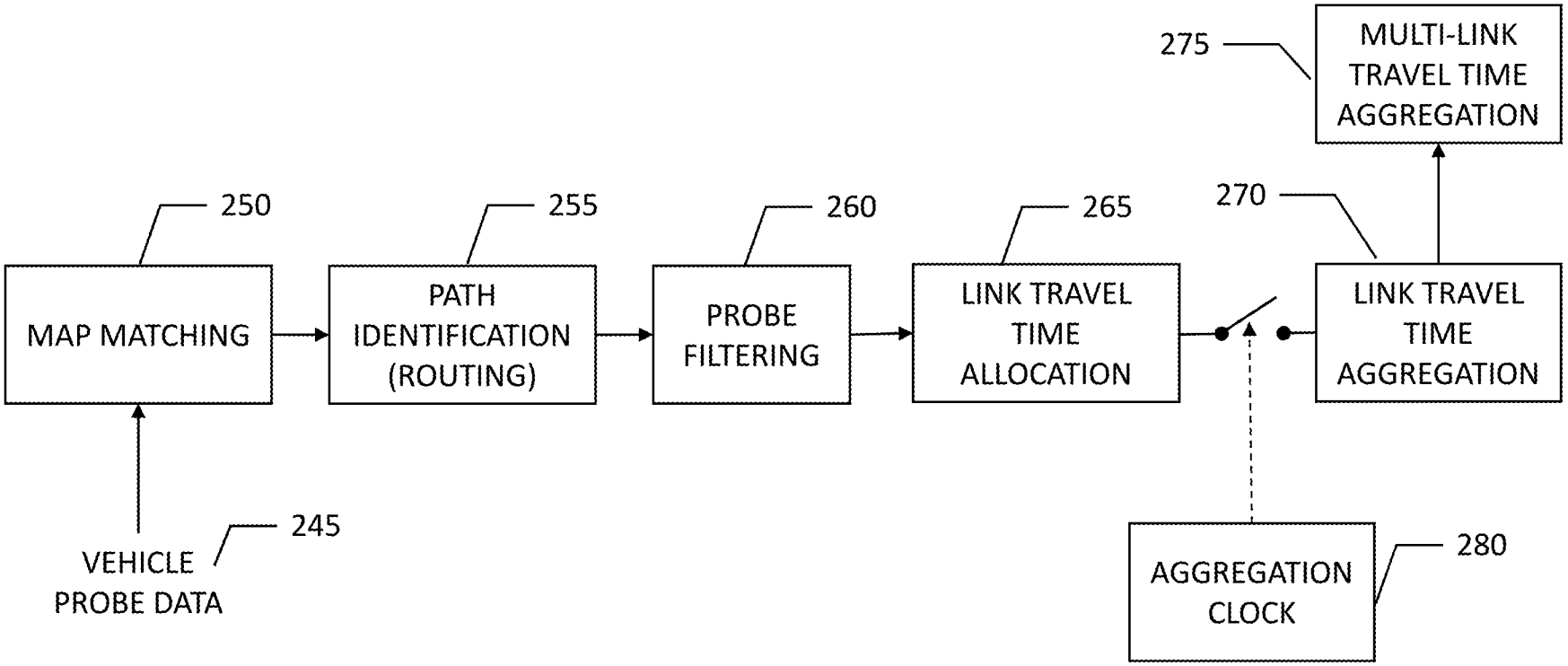
Figure 4:
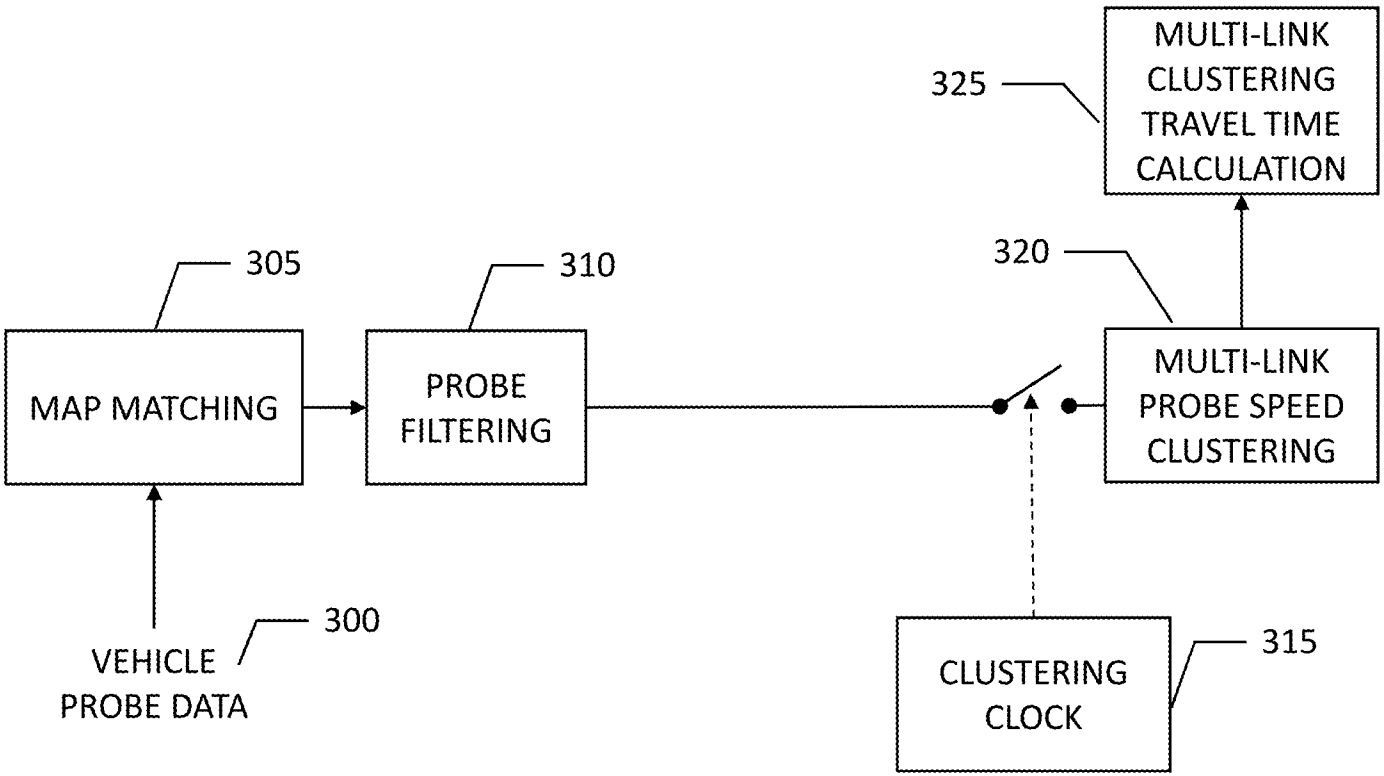
Figure 5:
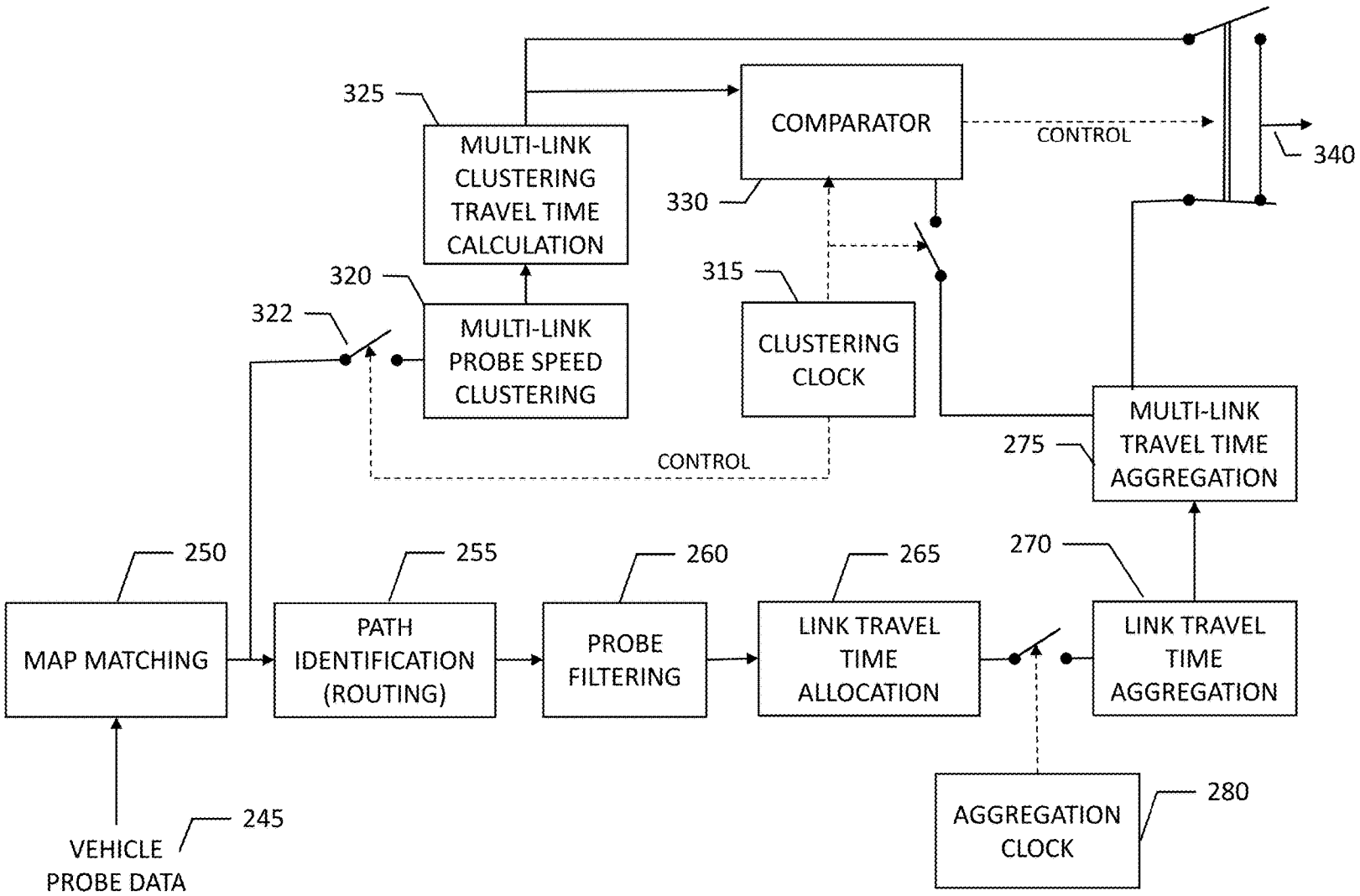
Figure 6:
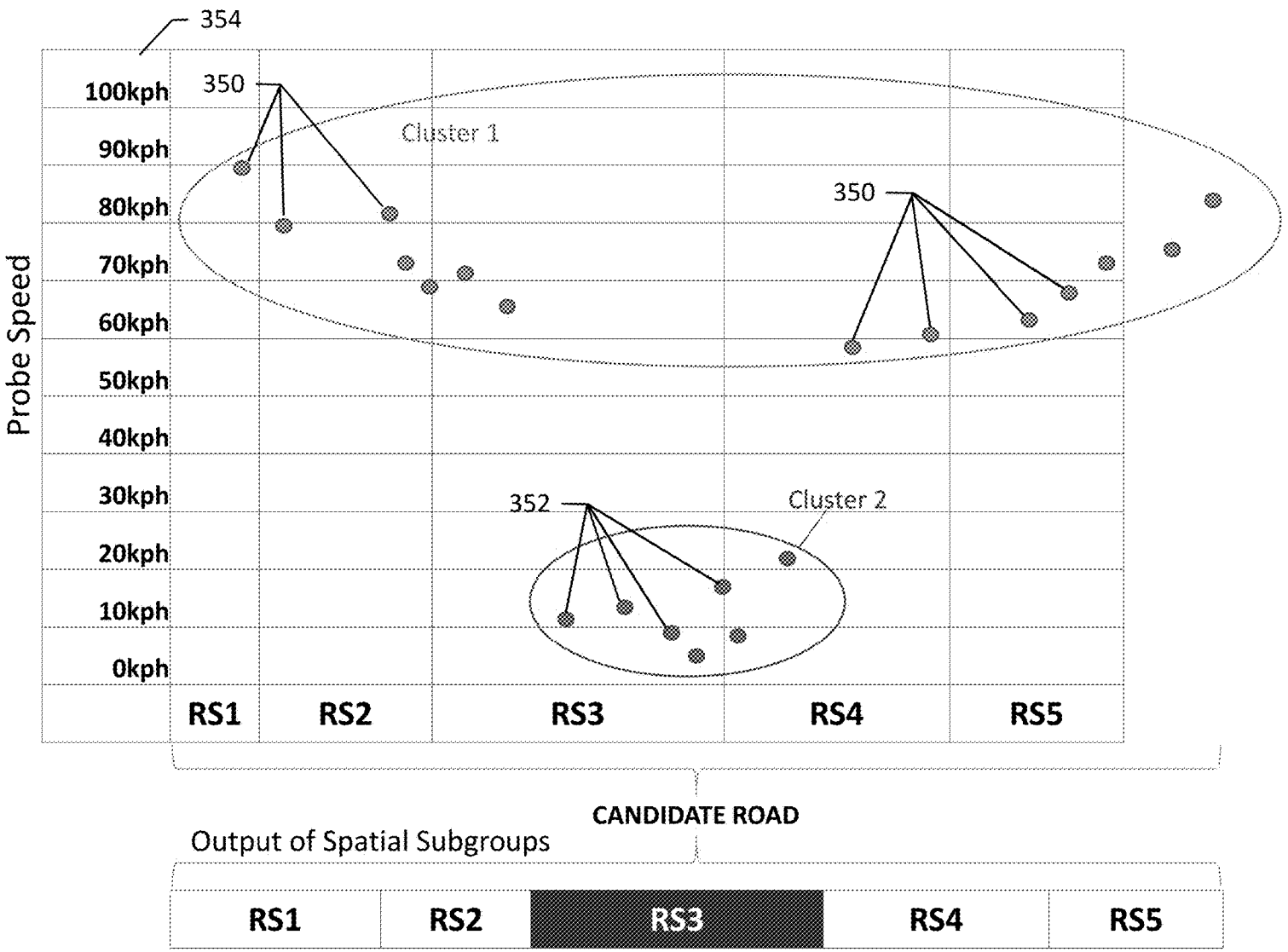
Figure 8:
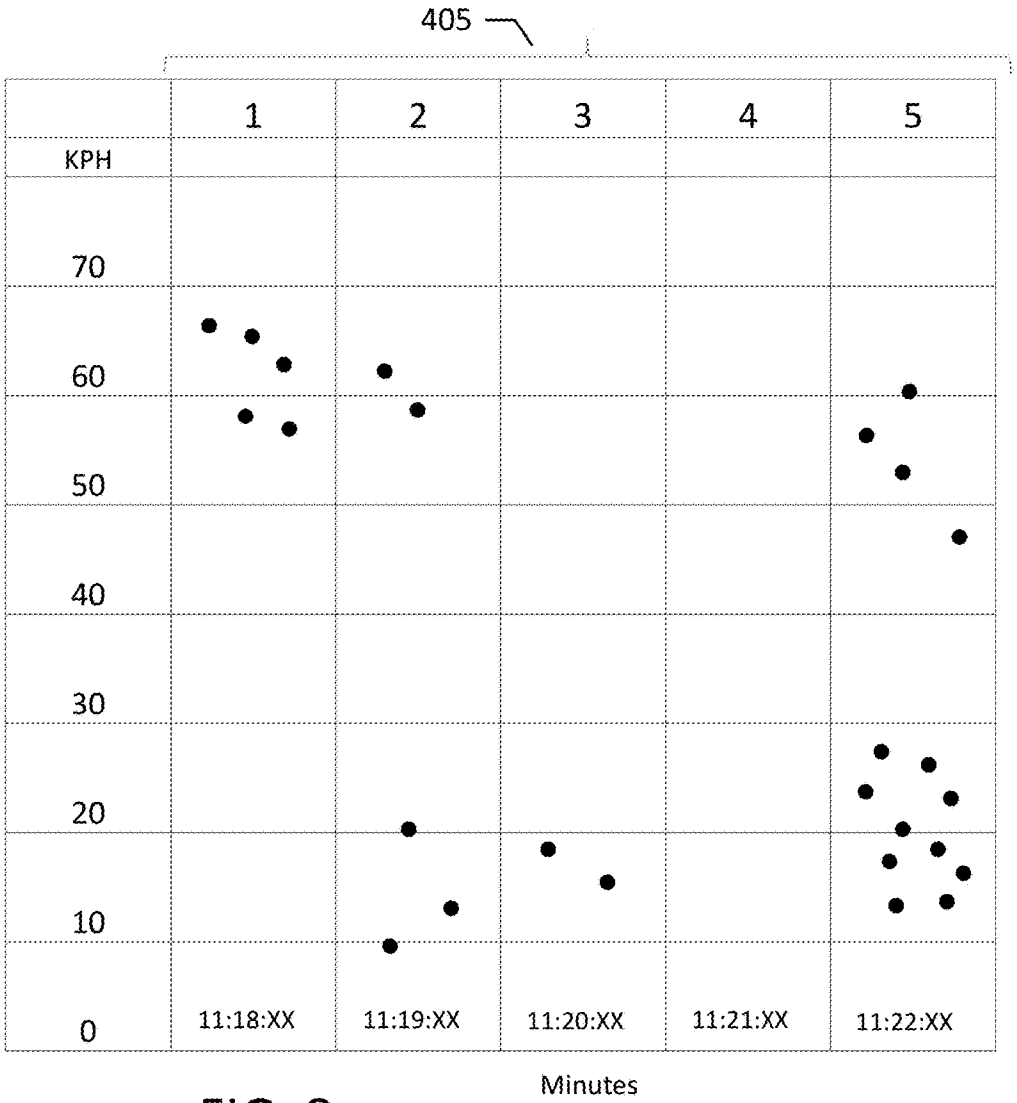
Figure 9:
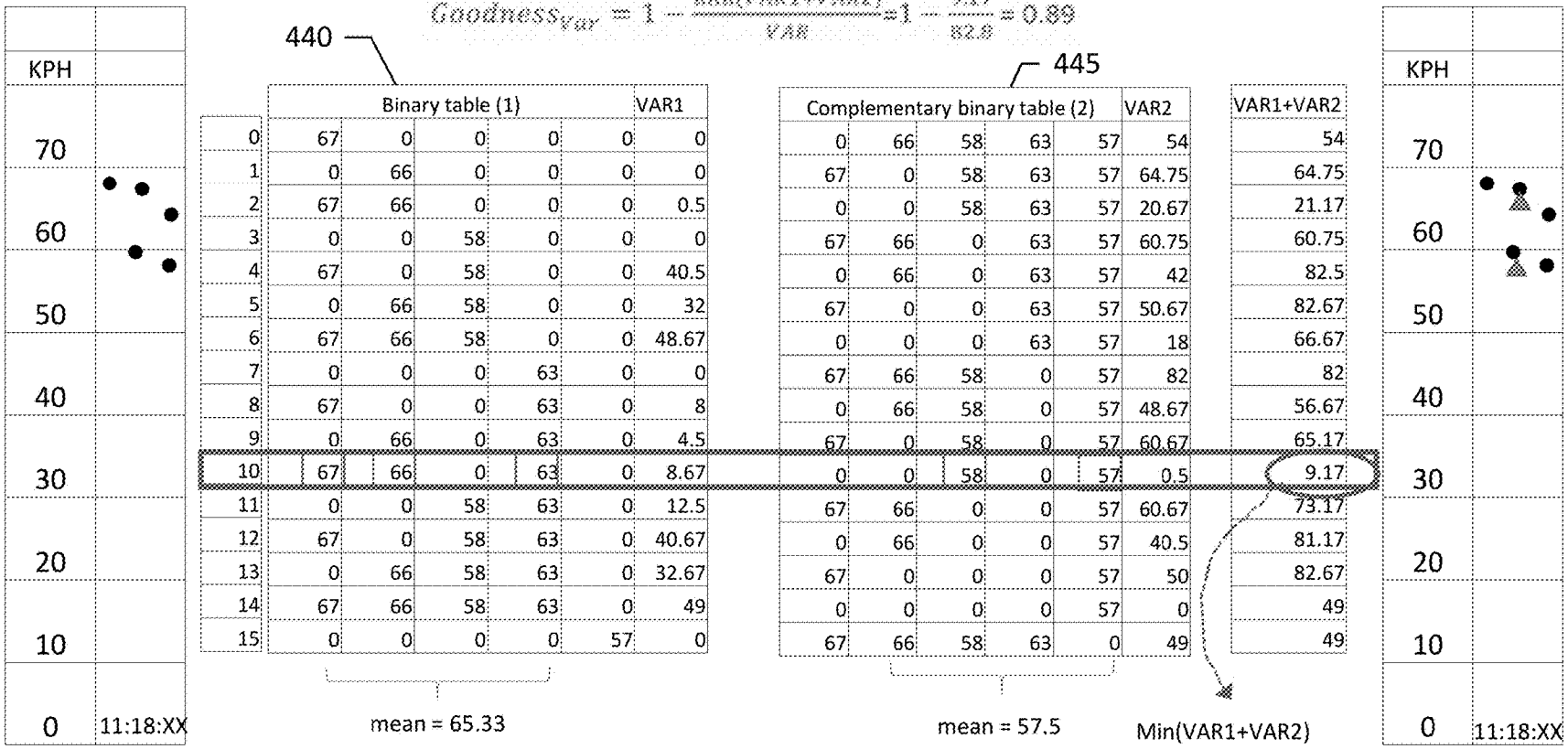
Figure 10:
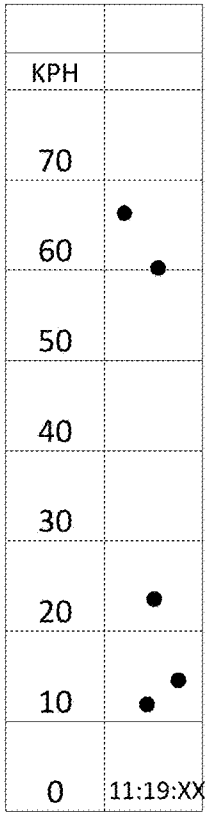
Figure 10:
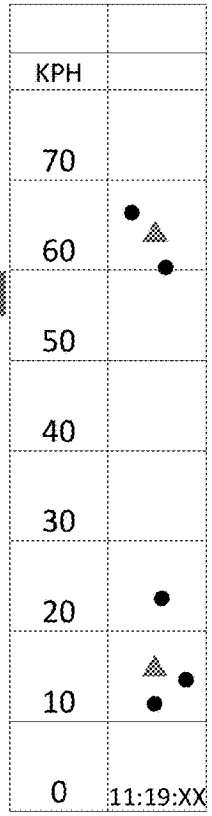
Figure 11:
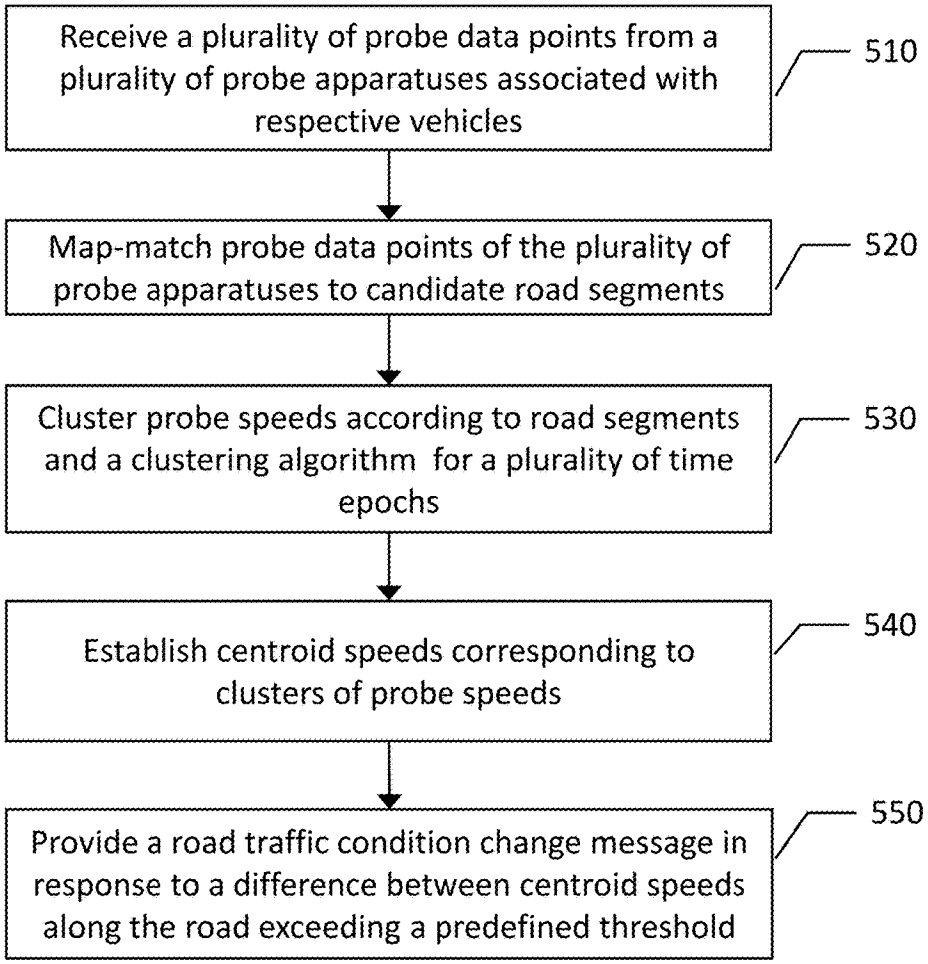

Having thus described example embodiments of the invention in general terms, reference will now be made to the accompanying drawings, which are not necessarily drawn to scale, and wherein:

FIG. 1 illustrates a communications diagram in accordance with an example embodiment;

FIG. 2 is a block diagram of an apparatus that may be specifically configured for establishing changes in traffic speeds along a road in accordance with an example embodiment described herein;

FIG. 3 illustrates a flowchart of a bottom-up process of identifying changes in traffic speeds along a road segment according to an example embodiment described herein;

FIG. 4 illustrates a flowchart of a top-down process of identifying changes in traffic speeds along a road segment according to an example embodiment described herein;

FIG. 5 illustrates a flowchart of a parallel process of identifying changes in traffic speeds along a road segment according to an example embodiment described herein;

FIG. 6 illustrates spatial link or road segment aggregation according to an example embodiment of the present disclosure;

FIG. 7 illustrates precompiled binary tables that may be used for establishing clusters based on maximizing the goodness of variance fit according to an example embodiment described herein;

FIG. 8 illustrates an example embodiment of a collected vehicle probe data divided by epochs;

FIG. 9 illustrates variance based clustering of an epoch of collected vehicle probe data of FIG. 8 according to an example embodiment of the present disclosure;

FIG. 10 illustrates variance based clustering of another epoch of collected vehicle probe data of FIG. 8 according to an example embodiment of the present disclosure; and FIG. 11 is a flowchart of a method for detecting changes in road traffic conditions according to an example embodiment of the present disclosure.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

A method, apparatus, and computer program product are provided herein in accordance with an example embodiment for detecting changes in road traffic conditions based on vehicle probe data. FIG. 1 illustrates a communication diagram of an example embodiment of a system for implementing example embodiments described herein. The illustrated embodiment of FIG. 1 includes a map services provider system 116, a processing server 102 in data communication with a user equipment (UE) 104 and/or a geographic map database, e.g., map database 108 through a network 112, and one or more mobile devices 114. The mobile device 114 may be associated, coupled, or otherwise integrated with a vehicle, such as an advanced driver assistance system (ADAS), for example. Additional, different, or fewer components may be provided. For example, many mobile devices 114 may connect with the network 112. The map services provider 116 may include computer systems and networks of a system operator. The processing server 102 may include the map database 108, such as a remote map server. The network may be wired, wireless, or any combination of wired and wireless communication networks, such as cellular, Wi-Fi, internet, local area networks, or the like.

The user equipment 104 may include a mobile computing device such as a laptop computer, tablet computer, mobile phone, smart phone, navigation unit, personal data assistant, watch, camera, or the like. Additionally or alternatively, the user equipment 104 may be a fixed computing device, such as a personal computer, computer workstation, kiosk, office terminal computer or system, or the like. Processing server 102 may be one or more fixed or mobile computing devices. The user equipment 104 may be configured to access the map database 108 via the processing server 102 through, for example, a mapping application, such that the user equipment may provide navigational assistance to a user among other services provided through access to the map services provider 116.

The map database 108 may include node data, road segment data or link data, point of interest (POI) data, or the like. The map database 108 may also include cartographic data, routing data, and/or maneuvering data. According to some example embodiments, the road segment data records may be links or segments representing roads, streets, or paths, as may be used in calculating a route or recorded route information for determination of one or more personalized routes. The node data may be end points corresponding to the respective links or segments of road segment data. The road link data and the node data may represent a road network, such as used by vehicles, cars, trucks, buses, motorcycles, and/or other entities. Optionally, the map database 108 may contain path segment and node data records or other data that may represent pedestrian paths or areas in addition to or instead of the vehicle road record data, for example. The road/link segments and nodes can be associated with attributes, such as geographic coordinates, street names, address ranges, speed limits, turn restrictions at intersections, and other navigation related attributes, as well as POIs, such as fueling stations, hotels, restaurants, museums, stadiums, offices, auto repair shops, buildings, stores, parks, etc. The map database 108 can include data about the POIs and their respective locations in the POI records. The map database 108 may include data about places, such as cities, towns, or other communities, and other geographic features such as bodies of water, mountain ranges, etc. Such place or feature data can be part of the POI data or can be associated with POIs or POI data records (such as a data point used for displaying or representing a position of a city). In addition, the map database 108 can include event data (e.g., traffic incidents, construction activities, scheduled events, unscheduled events, etc.) also known as a context associated with the POI data records or other records of the map database 108.

The map database 108 may be maintained by a content provider e.g., a map services provider in association with a services platform. By way of example, the map services provider can collect geographic data to generate and enhance the map database 108. There can be different ways used by the map services provider to collect data. These ways can include obtaining data from other sources, such as municipalities or respective geographic authorities. In addition, the map services provider can employ field personnel to travel by vehicle along roads throughout the geographic region to observe features and/or record information about them, for example. Also, remote sensing, such as aerial or satellite photography, can be used to generate map geometries directly or through machine learning as described herein. Further, crowd-sourced data from vehicles traveling along the road links in the road network may provide information relating to their respective speed of travel, which may inform the map services provider with respect to vehicle speeds, such as lane level vehicle speed profiles.

The map database 108 may be a master map database stored in a format that facilitates updating, maintenance, and development. For example, the master map database or data in the master map database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data may be compiled (such as into a platform specification format (PSF) format) to organize and/or configure the data for performing navigation-related functions and/or services, such as route calculation, route guidance, map display, speed calculation, distance and travel time functions, and other functions, by a navigation device, such as by user equipment 104, for example. The navigation-related functions can correspond to vehicle navigation, pedestrian navigation, or other types of navigation. While example embodiments described herein generally relate to vehicular travel along roads, example embodiments may be implemented for pedestrian travel along walkways, bicycle travel along bike paths, boat travel along maritime navigational routes, etc. The compilation to produce the end user databases can be performed by a party or entity separate from the map services provider. For example, a customer of the map services provider, such as a navigation device developer or other end user device developer, can perform compilation on a received map database in a delivery format to produce one or more compiled navigation databases.

As mentioned above, the server side map database 108 may be a master geographic database, but in alternate embodiments, a client side map database 108 may represent a compiled navigation database that may be used in or with end user devices (e.g., user equipment 104) to provide navigation and/or map-related functions. For example, the map database 108 may be used with the end user device 104 to provide an end user with navigation features. In such a case, the map database 108 can be downloaded or stored on the end user device (user equipment 104) which can access the map database 108 through a wireless or wired connection, such as via a processing server 102 and/or the network 112, for example.

In one embodiment, the end user device or user equipment 104 can be an in-vehicle navigation system, such as an ADAS, a personal navigation device (PND), a portable navigation device, a cellular telephone, a smart phone, a personal digital assistant (PDA), a watch, a camera, a computer, and/or other device that can perform navigation-related functions, such as digital routing and map display. An end user can use the user equipment 104 for navigation and map functions such as guidance and map display, for example, and for determination of one or more personalized routes or route segments based on one or more calculated and recorded routes, according to some example embodiments.

The processing server 102 may receive probe data from a mobile device 114. The mobile device 114 may include one or more detectors or sensors as a positioning system built or embedded into or within the interior of the mobile device 114. Alternatively, the mobile device 114 uses communications signals for position determination. The mobile device 114 may receive location data from a positioning system, such as a global positioning system (GPS), cellular tower location methods, access point communication fingerprinting, or the like. The server 102 may receive sensor data configured to describe a position of a mobile device, or a controller of the mobile device 114 may receive the sensor data from the positioning system of the mobile device 114. The mobile device 114 may also include a system for tracking mobile device movement, such as rotation, velocity, or acceleration. Movement information may also be determined using the positioning system. The mobile device 114 may use the detectors and sensors to provide data indicating a location of a vehicle. This vehicle data, also referred to herein as "probe data", may be collected by any device capable of determining the necessary information, and providing the necessary information to a remote entity. The mobile device 114 is one example of a device that can function as a probe to collect probe data of a vehicle.

More specifically, probe data (e.g., collected by mobile device 114) is representative of the location of a vehicle at a respective point in time and may be collected while a vehicle is traveling along a route. While probe data is described herein as being vehicle probe data, example embodiments may be implemented with pedestrian probe data or non-motorized vehicle probe data (e.g., from bicycles, skate boards, horseback, etc.). According to the example embodiment described below with the probe data being from motorized vehicles traveling along roadways, the probe data may include, without limitation, location data, (e.g. a latitudinal, longitudinal position, and/or height, GPS coordinates, proximity readings associated with a radio frequency identification (RFID) tag, or the like), rate of travel, (e.g. speed), direction of travel, (e.g. heading, cardinal direction, or the like), device identifier, (e.g. vehicle identifier, user identifier, or the like), a time stamp associated with the data collection, or the like. The mobile device 114, may be any device capable of collecting the aforementioned probe data. Some examples of the mobile device 114 may include specialized vehicle mapping equipment, navigational systems, mobile devices, such as phones or personal data assistants, or the like.

An example embodiment of a processing server 102 may be embodied in an apparatus as illustrated in FIG. 2. The apparatus, such as that shown in FIG. 2, may be specifically configured in accordance with an example embodiment of the present disclosure for detecting changes in road traffic conditions. The apparatus may include or otherwise be in communication with a processing circuitry 202, a memory device 204, a communication interface 206, and a user interface 208. In some embodiments, the processing circuitry (and/or co-processors or any other processing circuitry assisting or otherwise associated with the processing circuitry) may be in communication with the memory device via a bus for passing information among components of the apparatus. The memory device may be non-transitory and may include, for example, one or more volatile and/or non-volatile memories. In other words, for example, the memory device may be an electronic storage device (for example, a computer readable storage medium) comprising gates configured to store data (for example, bits) that may be retrievable by a machine (for example, a computing device like the processing circuitry 202). The memory device may be configured to store information, data, content, applications, instructions, or the like, for enabling the apparatus to carry out various functions in accordance with an example embodiment of the present invention. For example, the memory device could be configured to buffer input data for processing by the processing circuitry. Additionally or alternatively, the memory device could be configured to store instructions for execution by the processing circuitry.

The processing circuitry 202 may be embodied in a number of different ways. For example, the processing circuitry may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processing circuitry may include one or more processing cores configured to perform independently. A multi-core processor may enable multiprocessing within a single physical package. Additionally or alternatively, the processing circuitry may include one or more processors configured in tandem via the bus to enable independent execution of instructions, pipelining and/or multithreading.

In an example embodiment, the processing circuitry 202 may be configured to execute instructions stored in the memory device 204 or otherwise accessible to the processing circuitry. Alternatively or additionally, the processing circuitry may be configured to execute hard coded functionality. As such, whether configured by hardware or software methods, or by a combination thereof, the processing circuitry may represent an entity (for example, physically embodied in circuitry) capable of performing operations according to an embodiment of the present invention while configured accordingly. Thus, for example, when the processing circuitry is embodied as an ASIC, FPGA or the like, the processing circuitry may be specifically configured hardware for conducting the operations described herein. Alternatively, as another example, when the processing circuitry is embodied as an executor of software instructions, the instructions may specifically configure the processing circuitry to perform the algorithms and/or operations described herein when the instructions are executed. However, in some cases, the processing circuitry may be a processor specific device (for example, a mobile terminal or a fixed computing device) configured to employ an embodiment of the present invention by further configuration of the processing circuitry by instructions for performing the algorithms and/or operations described herein. The processing circuitry may include, among other things, a clock, an arithmetic logic unit (ALU) and logic gates configured to support operation of the processing circuitry.

The apparatus 200 of an example embodiment may also include a communication interface 206 that may be any means such as a device or circuitry embodied in either hardware or a combination of hardware and software that is configured to receive and/or transmit data to/from a communications device in communication with the apparatus, such as to facilitate communications with one or more user equipment 104 or the like. In this regard, the communication interface may include, for example, an antenna (or multiple antennae) and supporting hardware and/or software for enabling communications with a wireless communication network. Additionally or alternatively, the communication interface may include the circuitry for interacting with the antenna(s) to cause transmission of signals via the antenna(s) or to handle receipt of signals received via the antenna(s). In some environments, the communication interface may alternatively or also support wired communication. As such, for example, the communication interface may include a communication modem and/or other hardware and/or software for supporting communication via cable, digital subscriber line (DSL), universal serial bus (USB) or other mechanisms.

The apparatus 200 may also include a user interface 208 that may, in turn be in communication with the processing circuitry 202 to provide output to the user and, in some embodiments, to receive an indication of a user input. As such, the user interface may include a display and, in some embodiments, may also include a keyboard, a mouse, a joystick, a touch screen, touch areas, soft keys, one or more microphones, a plurality of speakers, or other input/output mechanisms. In one embodiment, the processing circuitry may comprise user interface circuitry configured to control at least some functions of one or more user interface elements such as a display and, in some embodiments, a plurality of speakers, a ringer, one or more microphones and/or the like. The processing circuitry and/or user interface circuitry comprising the processor may be configured to control one or more functions of one or more user interface elements through computer program instructions (for example, software and/or firmware) stored on a memory accessible to the processing circuitry (for example, memory device 204, and/or the like).

Embodiments of the present disclosure may facilitate the detection of changes in road traffic conditions, which may be useful for developing navigational routes to avoid high traffic areas, or may be used in establishing routes between an origin and a destination, in consideration of the road traffic conditions. Embodiments may further inform autonomous or semi-autonomous vehicles with respect to safe navigation proximate high traffic/slow speed areas and to potentially avoid such areas if faster routes are available. Embodiments provide insight into vehicle speeds along road segments of a road network, which can be used in real time or used for future epochs given the vehicle speeds and traffic conditions at historical epochs similar to future epochs.

Road traffic conditions of a road segment may be reflected in the speed of traffic along that road segment. Changes in traffic conditions, such as congestion forming/ending occur because the number of vehicles on the road segment has risen/fallen below the road capacity, or as a result of upstream propagation of the effects of a road incident (e.g., accident, hazardous road conditions, etc.). In order to provide the highest quality road information to drivers, it is important to accurately detect the location of changing traffic conditions and report them with minimal delay. Changes in traffic conditions may typically be characterized by divergence in the speeds reported by the vehicles and as such, pose a hard challenge for the algorithms used to determine traffic speed. These algorithms are commonly based on some type of averaging of vehicle speeds within a temporal window. The averaging may be used to stop the algorithm from overreacting to the speed of outliers. The temporal windowing supports collection of a larger number of inputs, such as vehicle speeds in order to compute traffic speed with a higher degree of confidence. Unfortunately, both mechanisms make traditional traffic speed algorithms more likely to miss early signs of change in traffic conditions, and therefore report it with higher latency.

Another challenge in accurately identifying changes in traffic conditions with low latency is to increase the spatial accuracy of the reported change in road conditions. In approaches where the traffic model is first applied on individual road segments, and only then adjacent segments may be combined to exploit spatial correlations, some of the key data is already lost by the time that spatial processing happens because of averaging and temporal smoothing happening in the traffic model. This "bottoms up" approach is not just potentially less spatially accurate, but it is also computationally more intensive as it requires the traffic model to be applied to all the segments, although effectively a large portion of the produced segment information is redundant and discarded in the second step.

Finally, the traffic models may use as input reported vehicle speed, derived vehicle travel times, or vehicle speed. The derived travel time and speed are computed from vehicle reported GPS locations and time stamps. The practice of using derived travel time/speed as model input may have two benefits: better coverage of the road segments e.g., larger number of inputs to the traffic model and less reliance on potentially erroneous speed reported by the vehicle. Unfortunately, this practice also smooths the information reported by the vehicles on the road and therefore makes it harder to pinpoint the time and location of changes in the vehicle speed and, by extension, possible changes in traffic conditions.

Typically, traffic models are incapable of satisfying opposing requirements of both correctly reflecting the smooth continuous nature of traffic conditions present in a majority of cases while at the same time being able to react quickly in a finite number of instances in which traffic conditions are changing along a finite number of road segments.

Provided herein is a solution including low latency and high spatial accuracy in reporting changes in traffic conditions. The proposed solution is a top-down model based on the clustering of reported speeds along road segments during time epochs. Embodiments of the present disclosure can include a model that can be used in the system in two different capacities: as a supplement to a more traditional traffic speed/flow model, or as a stand-alone model.

FIG. 3 illustrates an example embodiment of a bottom-up architecture for establishing changes in road conditions. As shown, vehicle probe data 245 is received, such as by map service provider 116, and processed for map matching at 250, whereby the probe data, which may include GPS coordinates of a location, time stamp, speed, heading, etc., is map-matched to a road segment of a network of roads. At 255, routing is established between two consecutive reported probe data points from a vehicle, and all of the road segments in the map traversed by the vehicle are established. Probe filtering occurs at 260, whereby probe data points failing to satisfy at least one predetermined criterion may be considered data points of low quality and may be discarded. Consecutive probe data points are combined at 265 to establish the travel time between points, and this travel time is allocated to all of the road segments the vehicle traversed as established through the path identification. At this point, the input to the traffic model is available to provide traffic flow data to or from a map services provider 116.

The model of FIG. 3 may aggregate the travel times/speeds for a particular road segment during a single epoch (e.g., for one minute of time) using most commonly a combination of weighing, windowing, and averaging. The aggregation clock 280 may define the epochs for which travel times are aggregated at 270. The travel times for a plurality of links are aggregated at 275 to generate the traffic data used for graphical presentation to a user.

Using the approach described with respect to FIG. 3 results in constant computation of vehicle travel speeds along all road segments from all vehicle probes. Further, the vehicle speeds are gathered along short road segments/links, which may have substantial deviation between them, particularly for very short road segments. Shorter road segments may include fewer probe data points, such that individual vehicle probes could throw off a calculation for that road segment. Embodiments described herein include a top-down approach can avoid constant computation of speeds for all road segments and probes, and can identify when vehicle speed calculation is necessary to avoid undue use of processing capacity.

FIG. 4 illustrates an example embodiment of an architecture used to implement the top-down approach of methods described herein. As shown, vehicle probe data 300 is received as conventional and map-matched at 305 with probe data point filtering happening at 310. Path identification is not necessary as the clustering model of this approach works directly on the reported probe data to avoid any loss of information due to smoothing between consecutive probes. With the described clustering approach, the probe data from several neighboring road links/segments is considered together. The collected, filtered probe data may be clustered according to epochs, such as using one minute intervals by clustering clock 315. The data is clustered at 320 using a clustering algorithm instead of averaged and smoothed using a technique of identifying natural breaks, such as using a modified Jenks natural breaks optimization method. The spatial information (e.g., the road segment information) may also be maintained during clustering and used in block 325 to create individual road segment travel times, but only as necessary.

Traffic speeds along road segments are important to drivers; however, drivers are most interested in when vehicle speeds are below normal speeds since those are the primary factors that influence route guidance and travel time. Since the method of FIG. 4 uses a top-down approach, vehicle speeds of clusters are known before performing substantial processing, and allows multi-link clustering travel time calculations performed at block 325 to be performed only when the multi-link probe speed clusters are indicating a reduction in traffic speed from free-flow traffic speeds.

Embodiments of the clustering model depicted in FIG. 4 also provide a low-latency, high efficiency method of establishing changes to traffic speeds which can avoid the constant calculations associated with each individual probe data point processed and may instead cluster probes along groups of road segments ("multi-link") and process the clusters together to establish travel time. This method reduces latency by improving response time between when traffic speed changes are detected and when they are reported through a traffic report or link speed update. The traffic report or link speed information may be used by map service provider 116 to inform travelers along the road network and inform route guidance which may encounter traffic congestion along a planned route.

FIG. 5 illustrates an example embodiment of how the proposed clustering based model can supplement more conventional bottom-up models to improve efficiencies with respect to processing and to more accurately and quickly identify changes in traffic speeds. By using the clustering model of embodiments described herein, conventional bottom-up modeling approaches can be improved without requiring full-scale implementation of a new traffic speed determination model.

As shown, the embodiment of FIG. 5 includes receipt of vehicle probe data 245 and map matching 250 thereof. The bottom-up approach of FIG. 3 is followed as conventional. However, as the clustering clock 315 controls the gathering of clusters over epochs and closes logic switch 322, the map matched vehicle probe data is processed as depicted in FIG. 5, by being clustered on a plurality of road segments at 320, and the clusters are then processed through multi-link clustering travel time calculations at 325. A comparator 330 is used to compare the outputs of the two methods represented in FIGS. 3 and 4, and to control which method is used to generate the traffic report output at 340. The multi-link clustering travel time calculation may be used in an instance in which the traffic along a road segment or plurality of road segments is reduced below a predefined value, particularly when the multi-link clustering time travel calculation detects such a change before the multi-link travel time aggregation 275. The comparator may determine which travel time calculation to use, and provide that travel time calculation as output. In this manner, the travel time may be both timely and precise. Using the multi-link clustering travel time calculation, the travel time along road segments may be known sooner and with higher accuracy than using the conventional approach. The multi-link travel time aggregation of FIG. 3 may include more granular data with respect to individual road segments, and thus may remain beneficial when the travel time calculations are accurate.

According to the embodiment of FIG. 5, the models of FIGS. 3 and 4 can coexist and run in parallel, with conventional traffic model computing the road segment speed the majority of the time. The clustering model described herein monitors the distribution of the speeds being used by the conventional model, and only if divergence in the speeds is detected at comparator 330, does the traffic conditions reporting switch to the clustering model. Once traffic conditions have stabilized, the reporting may be transferred back over to a traditional system.

The multi-link probe clustering block of 320 implements the proposed clustering algorithm of example embodiments described herein. The clustering of input probes corresponding to neighboring road segments is performed once per epoch, as governed by the clustering clock 315. The neighboring links/road segments may be selected according to links within a traffic messaging channel (TMC), for example. The epoch length may be a tunable parameter of the model, which may depend on the availability of the input data, desired latency, and confidence with which the model would be reporting. The epochs can be selected as longer or shorter periods of time. One minute may be a shorter time for the epoch used by clustering clock 315, while five to ten minutes may be used for a longer epoch, which may be used during times of lower traffic flow or fewer changes in traffic flow.

According to example embodiments described herein, once the input probe data points are selected, the clustering may be performed by maximizing the goodness of variance fit. The number of probe data points selected may be less than the number of probe data points available. All possible breaks of the set of probe data point speeds into subsets may be considered and the break where the variance of the speed within each of the subsets is minimal may be selected, thus ensuring consistency among the vehicle speeds along the clustered road segments. The number of subset combinations available will depend upon the size of the set (e.g., the number of road segments in each set), which may be used to control the computational power necessary for the clustering. Embodiments described herein may limit the number of input probes considered for clustering to improve efficiency and reduce the amount of necessary processing capacity. In cases where there is a large volume of input probes available, a fraction of the available data may be used, which improves efficiency by reducing latency and reducing necessary processing capacity. As an example, input data may be limited to a predetermined number of probes, such as twelve probes for a set of road segments. Embodiments may further optimize the algorithm implementation by generating a set of precompiled tables that facilitate the search for the best break for breaking groups of road segments into subsets. The table size and content may be a function of the selected number of probes that will be considered in each epoch and for each group of road segments.

According to some embodiments, the limiting of the number of probes by discarding some of the inputs may be performed in such a way as to not discard probes that could indicate a potential divergence in reported vehicle speeds as those probes are crucial in detecting the change in road conditions with minimal latency. This may be achieved by first sorting all of the available probes by their speed and selecting the probes with the minimum and maximum speeds. Next, two non-overlapping sets of probes may be created corresponding to 50% of slower probes in the ranked list and 50% of the faster probes. Half of the remaining probes may then be randomly selected from the set of lower speeds and the other half from the set of higher speeds. This ensures that even after discarding superfluous probes, the remaining probes used by the clustering algorithm may be representative of the full set.

The bottom-up approach assesses traffic for each road segment/link followed by aggregation to a "TMC" or "Traffic Messaging Channel" level involving a group of road segments/links. This process is time consuming and requires substantial processing capacity. Conversely, the top-down approach described herein uses a process that reduces latency and processing requirements. Probe data points are map matched, and for each traffic message channel segment, probe data points corresponding to that segment are identified. Clustering algorithms are run on the probe data points to cluster the speeds. Cluster centroids are identified and the difference between centroid speeds is calculated. If the speed difference is above a predefined threshold, a change in traffic conditions is detected. Spatial link aggregation can then be performed according to the cluster assignment to establish the location of the change in traffic conditions. The predefined threshold may be a defined speed (e.g., 15 miles per hour/25 kilometers per hour) or a percentage/proportion of a free-flow speed (e.g., 75% of free-flow speed). Thus, embodiments described herein do not focus on data aggregation but on event detection.

FIG. 6 illustrates an example embodiment of spatial link or road segment aggregation. As shown, a plurality of probe data points 350, 352 are received from along a candidate road including a plurality of consecutive road segments RS1 through RS5 including speeds 354 between zero KPH and 90 KPH. As shown, the probe data points fall into two distinct clusters, where Cluster 1 includes the probe data points 350 along road segments RS1, RS2, RS4, and RS5, while Cluster 2 includes probe data points 352 along road segment RS3. The illustrated probe data of FIG. 6 is indicative of traffic congestion along segment RS3 of the candidate road, and substantially free-flow traffic along road segments RS1, RS2, RS4, and RS5. As such, the two clusters are formed of spatial subgroups according to the cluster groupings. When the candidate road represented in FIG. 6 is displayed on a map, road segments RS1 and RS2, and road segments RS4 and RS5 may appear in green, while road segment RS3 appears in red, providing an indication to a driver or user of a vehicle that congestion exists along a portion of the candidate road.

A clustering method of example embodiments described herein may be variance based clustering for maximizing the "goodness of variance fit" or "GVF" of the Jenks optimization method. Calculations are performed on the probe data points from a plurality of segments to identify the most appropriate place to "break" the road segments into groups. Calculations are repeated using different breaks in the dataset to determine which set of breaks has the smallest in-cluster variance. This process may be repeated until the sum of the within-cluster deviations reaches a minimal value such that the GVF reaches a maximum. GVF takes a value between 0 and 1, where the closer the GVF is to 1 the better the fit.

$$GVF = 1 - \frac{\text{minimal_variation}}{\text{dataset_variation}}$$

FIG. 7 illustrates precompiled binary tables that may be used for establishing clusters based on maximizing the GVF. As shown, a first binary table 360 is shown for vehicle probes $V_1$ through $V_5$. The binary table 360 is precompiled for all permutations of $V_1$ through $V_4$, while complementary binary table 365 is precompiled for the complementary iterations of $V_1$ through $V_4$. An example implementation of these tables is detailed further below.

FIG. 8 illustrates an example embodiment of a plurality of epochs 405, numbered 1 through 5, with each epoch being a one minute interval. The tables show each epoch and a recorded vehicle speed from probe data in that epoch. The graph provides an illustration thereof. As shown, the epoch of 11:18:XX shown in table 410 and in graph column 1, is a free-flow epoch where traffic speeds are between 58 and 67 kilometers per hour (KPH). In the epoch of 11:19:XX shown in table 415 and in graph column 2, the data shows a large divergence between the fastest speeds and the lowest speeds, such that the epoch represents transition. The speeds of the epoch of table 415 vary between 10 and 62 KPH. The epoch of 11:20:XX shown in table 420 and illustrated in graph column 3 includes only two data points, such that the low number of probes render the epoch unreliable. Similarly, there are too few/no data points for the epoch of 11:21:XX in table 425 and shown in graph column 4. In the epoch of 11:22:XX, shown in table 430 and illustrated in graph column 5, there are many data points, and a wide variance in speed from 12 to 60 KPH, such that the epoch of table 430 represents transition.

FIG. 9 illustrates the variance based clustering of the epoch of 11:18:XX of FIG. 8 using the complementary binary tables of FIG. 7. Five vehicle probe points are represented in each table, such as the first table 440 with 16 rows, where the first column includes row numbers, while the second through sixth column represent vehicle probe points. Where a binary value of 1 exists in the binary table 360 of FIG. 7, the vehicle probe speed is entered in the table 440 of FIG. 9. Similarly, in table 445, the complementary table illustrates the vehicle probe speeds in cells having a binary value of 1 in FIG. 7. The variance of each row in each table is calculated in the right-most column of each table. The variances are then summed to establish the total variance of the clustering represented by each row. The minimum variance is used in the GVF calculation, divided by the variance of the dataset, and subtracted from one as shown in the formula at the top of FIG. 7 and calculated for FIG. 9 at 450. The GVF for the 11:18:XX epoch is 0.89. A similar table is shown in FIG. 10 for epoch 11:19:XX. However, as illustrated in FIG. 8, with the probe data points showing considerably more spread in values, the minimum variance is much greater in FIG. 10. This variance is indicative of transitional traffic speeds, where some vehicles continue to travel at high speeds, while others have slowed or are slowing down. However, the goodness of variance fit, GVF, calculated at 460 is 0.98, and closer to a value of 1.0, such that the GVF of the data of FIG. 10 is considered a better fit. While the clustering technique of FIGS. 6-9 is illustrative of one, preferred example of variance based clustering; however, other clustering techniques may be implemented.

FIG. 11 illustrates a flowchart depicting a method according to example embodiments of the present invention. It will be understood that each block of the flowchart and combination of blocks in the flowchart may be implemented by various means, such as hardware, firmware, processor, circuitry, and/or other communication devices associated with execution of software including one or more computer program instructions. For example, one or more of the procedures described above may be embodied by computer program instructions. In this regard, the computer program instructions which embody the procedures described above may be stored by a memory device 204 of an apparatus employing an embodiment of the present invention and executed by a processing circuitry 202 of the apparatus. As will be appreciated, any such computer program instructions may be loaded onto a computer or other programmable apparatus (for example, hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions that execute on the computer or other programmable apparatus provide operations for implementing the functions specified in the flowchart blocks.

Accordingly, blocks of the flowcharts support combinations of means for performing the specified functions and combinations of operations for performing the specified functions. It will also be understood that one or more blocks of the flowcharts, and combinations of blocks in the flowcharts, can be implemented by special purpose hardware-based computer systems that perform the specified functions, or combinations of special purpose hardware and computer instructions.

FIG. 11 illustrates a flowchart of a method for detecting changes in road traffic conditions. As shown, at 510 a plurality of probe data points are received from a plurality of probe apparatuses associated with respective vehicles. The probe data points represent vehicles traveling along road segments of a road network and include location data along with speed data. The probe data points are map-matched at 520 to road segments of the road network along which the vehicles are traveling. For a plurality of time epochs, such as one-minute intervals for example, probe speeds are clustered based on the road segment along which they travel and a clustering algorithm. Centroid speeds for each cluster of probe speeds for a respective road segment and time epoch are established at 540. A road traffic condition change message is generated and provided in response to a difference between centroid speeds along the road exceeding a predefined threshold.

In an example embodiment, an apparatus for performing the method of FIG. 11 above may comprise a processor (e.g., the processing circuitry 202) configured to perform some or each of the operations (510-550) described above. The processing circuitry may, for example, be configured to perform the operations (510-550) by performing hardware implemented logical functions, executing stored instructions, or executing algorithms for performing each of the operations. Alternatively, the apparatus may comprise means for performing each of the operations described above. In this regard, according to an example embodiment, examples of means for performing operations 510-550 may comprise, for example, the processing circuitry 202 and/or a device or circuit for executing instructions or executing an algorithm for processing information as described above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A method for detecting changes in road traffic condition comprising:

receiving a plurality of probe data points, each probe data point received from a probe apparatus of a plurality of probe apparatuses, wherein the probe data points include at least probe speed information and probe location information associated with a respective probe apparatus;

map-matching probe data points of the plurality of probe apparatuses to road segments of a candidate road of a road network;

clustering the probe data points based on speed information using a clustering algorithm to form clusters of probe data points; and providing a road traffic condition change message in response to a difference between clusters of probe data points along the candidate road satisfying a predefined value.

2. The method of claim 1, wherein clustering the probe data points based on speed information using a clustering algorithm to form clusters of probe data points further comprises identifying cluster centroids, each cluster centroid having a cluster centroid speed, wherein providing a road traffic condition change message in response to a difference between clusters of probe data points along the candidate road satisfying a predefined value comprises providing a road traffic condition change message in response to a difference between cluster centroid speeds along the candidate road satisfying a predetermined value.

3. The method of claim 1, wherein clustering the probe data points based on speed information using a clustering algorithm to form clusters of probe data points comprises:

identifying within the probe data points a first set of break locations whereby probe data points are broken into clusters of probe data points;

calculating in-cluster variances for each cluster of probe data points using the first set of break locations;

identifying within the probe data points a second set of break locations whereby probe data points are broken into clusters of probe data points;

calculating in-cluster variances for each cluster of probe data points using the second set of break locations; and selecting one of the first set of break locations or the second set of break locations having lower in-cluster variances.

4. The method of claim 3, wherein clustering the probe data points based on speed information using a clustering algorithm to form clusters of probe data points comprises using the selected one of the first set of break locations or the second set of break locations to form the clusters of probe data points.

5. The method of claim 1, further comprising spatially grouping said road segments according to clusters of probe data points, wherein contiguous road segments sharing a cluster of probe data points are grouped.

6. The method of claim 1, wherein clustering the probe data points based on speed information using a clustering algorithm to form clusters of probe data points comprises:

calculating cluster variances using a set of pre-calculated binary tables;

minimizing a sum of at least two cluster variances in the set of pre-calculated binary tables; and identifying clusters based on the minimized sum of at least two cluster variances.

7. The method of claim 6, wherein the set of pre-calculated binary tables comprises a main binary table and a complementary binary table.

8. The method of claim 7, wherein a predefined number of probe data points are identified for each cluster, wherein a dimension of said binary tables is established as $2^{(N-1)}$, where N is the predefined number of probe data points.

9. An apparatus comprising processing circuitry and at least one memory including computer program code, the at least one memory and computer program code configured to, with the processing circuitry, cause the apparatus to at least:

receive a plurality of probe data points, each probe data point received from a probe apparatus of a plurality of probe apparatuses, wherein the probe data points include at least probe speed information and probe location information associated with a respective probe apparatus;

map-match probe data points of the plurality of probe apparatuses to road segments of a candidate road of a road network;

cluster the probe data points based on speed information using a clustering algorithm to form clusters of probe data points; and provide a road traffic condition change message in response to a difference between clusters of probe data points along the candidate road satisfying a predefined value.

10. The apparatus of claim 9, wherein causing the apparatus to cluster the probe data points based on speed information using a clustering algorithm to form clusters of probe data points further comprises causing the apparatus to identify cluster centroids, each cluster centroid having a cluster centroid speed, wherein causing the apparatus to provide a road traffic condition change message in response to a difference between clusters of probe data points along the candidate road satisfying a predefined value comprises causing the apparatus to provide a road traffic condition change message in response to a difference between cluster centroid speeds along the candidate road satisfying a predetermined value.

11. The apparatus of claim 9, wherein causing the apparatus to cluster the probe data points based on speed information using a clustering algorithm to form clusters of probe data points comprises causing the apparatus to:

identify within the probe data points a first set of break locations whereby probe data points are broken into clusters of probe data points;

calculate in-cluster variances for each cluster of probe data points using the first set of break locations;

identify within the probe data points a second set of break locations whereby probe data points are broken into clusters of probe data points;

calculate in-cluster variances for each cluster of probe data points using the second set of break locations; and select one of the first set of break locations or the second set of break locations having lower in-cluster variances.

12. The apparatus of claim 11, wherein causing the apparatus to cluster the probe data points based on speed information using a clustering algorithm to form clusters of probe data points comprises causing the apparatus to use the selected one of the first set of break locations or the second set of break locations to form the clusters of probe data points.

13. The apparatus of claim 9, further comprising causing the apparatus to spatially group said road segments according to clusters of probe data points, wherein contiguous road segments sharing a cluster of probe data points are grouped.

14. The apparatus of claim 9, wherein causing the apparatus to cluster the probe data points based on speed information using a clustering algorithm to form clusters of probe data points comprises causing the apparatus to:

calculate cluster variances using a set of pre-calculated binary tables;

minimize a sum of at least two cluster variances in the set of pre-calculated binary tables; and identify clusters based on the minimized sum of at least two cluster variances.

15. The apparatus of claim 14, wherein the set of pre-calculated binary tables comprises a main binary table and a complementary binary table.

16. The apparatus of claim 15, wherein a predefined number of probe data points are identified for each cluster, wherein a dimension of said binary tables is established as 2^(N−1), where N is the predefined number of probe data points.

17. A computer program product comprising at least one non-transitory computer-readable storage medium having computer-executable program code portions stored therein, the computer-executable program code portions comprising program code instructions configured to:

receive a plurality of probe data points, each probe data point received from a probe apparatus of a plurality of probe apparatuses, wherein the probe data points include at least probe speed information and probe location information associated with a respective probe apparatus;

map-match probe data points of the plurality of probe apparatuses to road segments of a candidate road of a road network;

cluster the probe data points based on speed information using a clustering algorithm to form clusters of probe data points; and provide a road traffic condition change message in response to a difference between clusters of probe data points along the candidate road satisfying a predefined value.

18. The computer program product of claim 17, wherein the program code instructions to cluster the probe data points based on speed information using a clustering algorithm to form clusters of probe data points further comprise program code instructions to identify cluster centroids, each cluster centroid having a cluster centroid speed, wherein the program code instructions to provide a road traffic condition change message in response to a difference between clusters of probe data points along the candidate road satisfying a predefined value comprise program code instructions to provide a road traffic condition change message in response to a difference between cluster centroid speeds along the candidate road satisfying a predetermined value.

19. The computer program product of claim 17, wherein the program code instructions to cluster the probe data points based on speed information using a clustering algorithm to form clusters of probe data points comprise program code instructions to:

identify within the probe data points a first set of break locations whereby probe data points are broken into clusters of probe data points;

calculate in-cluster variances for each cluster of probe data points using the first set of break locations;

identify within the probe data points a second set of break locations whereby probe data points are broken into clusters of probe data points;

calculate in-cluster variances for each cluster of probe data points using the second set of break locations; and select one of the first set of break locations or the second set of break locations having lower in-cluster variances.

20. The computer program product of claim 19, wherein the program code instructions to cluster the probe data points based on speed information using a clustering algorithm to form clusters of probe data points comprise program code instructions to use the selected one of the first set of break locations or the second set of break locations to form the clusters of probe data points.

* * * * *